US005207560A

United States Patent [19]

Urban

[11] Patent Number: 5,207,560

[45] Date of Patent: May 4, 1993

[54] FLUID FLOW MACHINE WITH VARIABLE CLEARANCES BETWEEN THE CASING AND A FLUID FLOW GUIDING INSERT IN THE CASING

[75] Inventor: Jörg Urban, Ludwigshafen, Fed. Rep. of Germany

[73] Assignee: KSB Aktiengesellschaft, Frankenthal, Fed. Rep. of Germany

[21] Appl. No.: 754,560

[22] Filed: Sep. 4, 1991

[30] Foreign Application Priority Data

Oct. 9, 1990 [DE] Fed. Rep. of Germany ..... 4031936

[51] Int. Cl.[5] ..... F01D 9/02

[52] U.S. Cl. ..... 415/199.1; 415/136; 415/138; 415/173.1; 415/173.3; 415/200; 277/18; 277/67; 277/DIG. 6

[58] Field of Search ..... 415/134, 136, 138, 170.1, 415/173.1, 173.3, 173.7, 174.2, 199.1, 200; 277/18, 25, 67, DIG. 6

[56] References Cited

U.S. PATENT DOCUMENTS

| | | | |
|---|---|---|---|
| 4,579,509 | 4/1986 | Jacobi | 415/199.1 |
| 4,778,334 | 10/1988 | Medgyesy et al. | 415/199.1 |
| 5,004,402 | 4/1991 | Burchette et al. | 415/138 |
| 5,080,557 | 1/1992 | Berger | 415/173.3 |
| 5,092,737 | 3/1992 | Lau | 415/173.2 |

FOREIGN PATENT DOCUMENTS

| | | | |
|---|---|---|---|
| 689618 | 3/1940 | Fed. Rep. of Germany . | |
| 2210951 | 2/1973 | Fed. Rep. of Germany | 415/199.1 |
| 0027093 | of 1906 | United Kingdom | 415/199.1 |

*Primary Examiner*—Edward K. Look
*Assistant Examiner*—Christopher M. Verdier
*Attorney, Agent, or Firm*—Peter K. Kontler

[57] ABSTRACT

A multi-stage centrifugal pump wherein a casing surrounds an impeller and a fluid flow guiding insert in each pump stage. The casing is made of a ferritic material, and the inserts are made of an austenitic material. The casing defines with each insert a first clearance wherein a cylindrical surface of the casing is surrounded by a cylindrical surface of the respective insert so that the width of the clearance increases in response to heating of the inserts and of the casing at the respective first clearances. The casing further defines with each insert a second clearance which is disposed radially outwardly of the respective first clearance and wherein a frustoconical surface of the casing surrounds a complementary frustoconical surface of the respective insert so that the width of each second clearance decreases in response to heating of the casing and of the inserts at the respective second clearances. The width of the first clearances is zero or close to zero within a relatively low first range of temperatures, and the width of the second clearances is zero or close to zero within a relatively high second range of temperatures.

17 Claims, 2 Drawing Sheets

FLUID FLOW MACHINE WITH VARIABLE CLEARANCES BETWEEN THE CASING AND A FLUID FLOW GUIDING INSERT IN THE CASING

BACKGROUND OF THE INVENTION

The invention relates to improvements in fluid flow machines in general, and more particularly to improvements in seals and fluid flow restrictors between the housings or casings and the flow guidance devices of such machines. Still more particularly, the invention relates to fluid leakage control systems in fluid flow machines, especially between the casings and diffusers of centrifugal pumps.

German Pat. No. 689618 granted Mar. 28, 1940 to Lindemann et al. discloses a system serving to compensate for different thermally induced expansion of neighboring machine parts which are not rotatable relative to each other and which are heated to different temperatures. Such compensation is often necessary in centrifugal pumps, especially in multi-stage centrifugal pumps which are used to convey hot fluids. Thermally induced expansion of diffusers (also called guide wheels) can present serious problems if their thermally induced expansion deviates from that of neighboring parts. This can entail the development of pronounced stresses. The patent to Lindemann et al. proposes to provide the guide wheels with deformable projections which can conform to the shapes of neighboring parts in that the parts (projections) which undergo more pronounced thermally induced expansion are free to slide relative to the neighboring parts. Thus, thermally induced different expansion of neighboring parts is compensated for by deformation of selected portions (projections) of the guide wheels.

The patent to Lindemann further proposes to insert specially designed parts, such as springs, if the expected changes in thermally induced expansion of neighboring parts are quite pronounced. This is intended to ensure that the clearances between neighboring parts are eliminated or are kept within an acceptable range.

OBJECTS OF THE INVENTION

An object of the invention is to provide a fluid flow machine, such as a centrifugal pump, with novel and improved means for controlling the width of one or more clearances between parts which do not or need not rotate relative to each other but should not permit unrestricted flow of a fluid between them.

Another object of the invention is to provide a fluid flow machine wherein the leakage of fluid between the casing and the flow guidance device or devices is controlled in a novel and improved way.

A further object of the invention is to provide a fluid flow machine wherein the leakage of conveyed fluid can be controlled with a high degree of accuracy even if the thermally induced expansion or contraction of neighboring parts is very pronounced.

An additional object of the invention is to provide a multi-stage centrifugal pump with novel and improved means for controlling the leakage of conveyed fluid between the casing and the flow guidance devices.

Still another object of the invention is to provide a fluid flow machine which can control the leakage of conveyed fluid even if the pressure of conveyed fluid is high or extremely high and even if the casing and the flow guidance device or devices undergo different expansion when the machine is in use.

A further object of the invention is to provide a novel and improved flow guidance device for use in a centrifugal pump or an analogous fluid flow machine.

An additional object of the invention is to provide a novel and improved casing for use in fluid flow machines, particularly in multi-stage centrifugal pumps for the conveying of hot fluids.

Another object of the invention is to provide a fluid flow machine for the conveying of hot fluids which is constructed and assembled in such a way that the rate of leakage of conveyed fluid between the casing and the flow guidance device or devices does not change in response to unequal heating and/or unequal thermally induced expansion of such parts.

A further object of the invention is to provide a novel and improved method of compensating for different expansion of the casing and neighboring part or parts in a fluid flow machine, particularly in a multi-stage centrifugal pump.

SUMMARY OF THE INVENTION

The invention is embodied in a fluid flow machine, particularly in a centrifugal pump. The machine comprises a housing or casing which consists of a first material having a first thermal expansion coefficient, at least one impeller which is rotatable in the casing about a predetermined axis, and at least one fluid guiding insert which is disposed in the casing adjacent the at least one impeller (for example, to guide the fluid from the at least one impeller in one stage to a second impeller in a next-following stage of a centrifugal pump) and consists of a second material having a second thermal expansion coefficient higher than the first coefficient (i.e., the at least one insert exhibits a greater tendency to expand in response to heating than does the casing). The casing and the at least one insert have first surfaces which are disposed at a first radial distance from the axis of rotation of the at least one impeller and define a first annular clearance. Furthermore, the casing and the at least one insert have second surfaces which are disposed at a greater second radial distance from the axis of rotation of the at least one impeller. One of the clearances has a width which is at least close to zero when the temperature at the respective surfaces (i.e., at the surfaces defining the one clearance) is within a first range, and the other of the clearances has a width which is at least close to zero when the temperature at the respective surfaces (namely at the surfaces defining the other clearance) is within a higher second range.

The casing can be made, either entirely or in part, of a ferritic material, and the insert can be made, either entirely or in part, of an austenitic material.

It is presently preferred to design the casing and the at least one insert in such a way that the one clearance is the first clearance (i.e., that clearance which is nearer to the axis of rotation of the at least one impeller). Thus, the width of the second clearance is greater than zero when the temperature at the second surfaces is within the first range (e.g., when the casing and the at least one insert are maintained at or close to room temperature).

The width of the first clearance can increase in response to a rise of temperature at the first surfaces; this can be achieved in a simple manner by causing the first surface of the at least one insert to at least partially surround the first surface of the casing.

The width of the second clearance will decrease in response to a rise of temperature at the second surfaces if the second surface of the casing at least partially surrounds the second surface of the at least one insert.

The arrangement may be such that the second surface of the casing is engaged by the second surface of the at least one insert and centers the at least one insert in the casing when the temperature at the second surfaces is within the second range, i.e., when the width of the second clearance is at least close to zero.

The second surfaces can constitute at least substantially complementary conical (particularly frustoconical) surfaces.

The second surface of the at least one insert can be provided on a deformable (preferably resilient) portion of the at least one insert. The at least one insert can be made of one piece or it can consist of at least two separately produced parts. For example, the at least one insert can comprise a channeled section and a cover for the channeled section. At least one of the first and second surfaces of the at least one insert can be provided on the cover. Such cover is preferably adjacent the channeled section of the at least one insert as seen in the axial direction of the at least one impeller.

A layer (particularly a thin film) of friction reducing material can be applied to at least one of the second surfaces to ensure that the at least one insert can slide relative to the casing and/or vice versa when the width of the second clearance is reduced to zero or close to zero.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
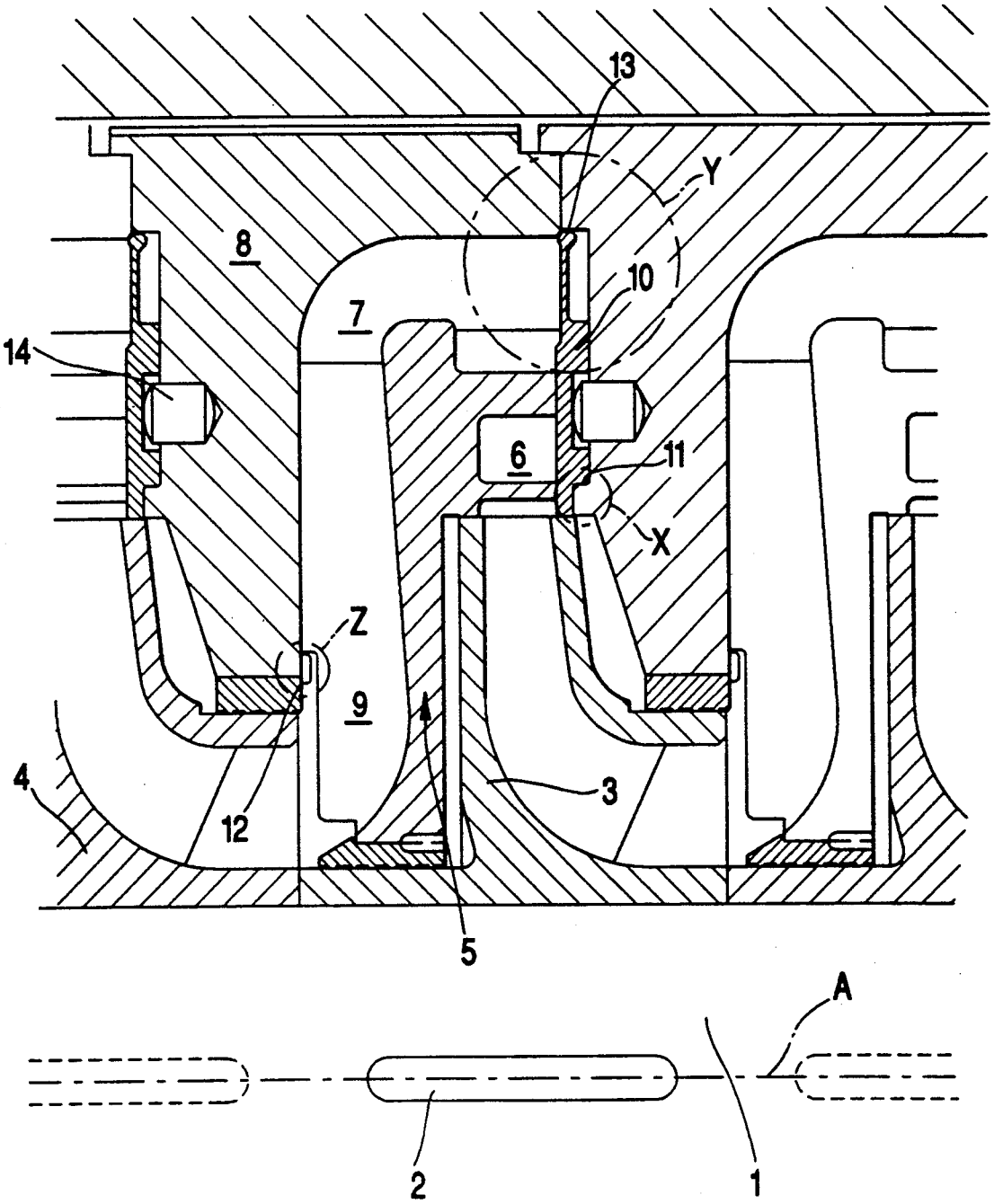
FIG. 1 is a fragmentary axial sectional view of a fluid flow machine which constitutes a multi-stage centrifugal pump and embodies one form of the invention.

FIG. 1 shows a portion of a fluid flow machine which constitutes a multi-stage centrifugal pump. The illustrated pump includes at least three stages and comprises a pump shaft 1 which can be driven by a motor (not shown) or by another suitable prime mover and is non-rotatably connected with impellers (including those denoted by the characters 3 and 4) of discrete stages by tongue-and-groove connections 2 or in any other suitable way. The impellers are rotatable about a common axis A in a composite housing or casing 8 having discrete interfitted coaxial sections, one for each of the stages. Pressurized fluid (e.g., a liquid) which issues from the impeller 3 is guided into the range of the next-following impeller 4 by a fluid guidance device 5 here shown as an insert which is confined in the casing 8 and includes a channeled and chambered section 9 and a cover or lid 10 which is adjacent the channels 6 of the section 9 as seen in the axial direction of the impellers. The direction of fluid flow is such that the fluid which flows from the impeller 3 first enters the channels 6 and thereupon a ring-shaped chamber 7 of the insert 5 between the impellers 3, 4 before it is caused to flow radially inwardly toward the inlet of the impeller 4. The housing 8 is designed to stand the pressures which develop when the fluid is compressed on its way through successive stages of the centrifugal pump. A portion of the internal surface of the casing 8 is immediately adjacent the ring-shaped chambers 9 of the inserts. The inserts which flank the referenced insert 5 are or can be identical with such referenced insert.

The insert 5 can be made of one piece from a material having a relatively high thermal expansion coefficient. Alternatively, and as actually shown in FIG. 1, the insert 5 can be assembled of several sections including the channeled and chambered section 9 and the cover or lid 10. The latter overlies the channels 6 in the section 9 of the insert 5. An advantage of making the entire insert 5 (i.e., the section 9 and the cover 10) of one and the same material (such as austenitic steel) is that the width of the clearance or clearances (if any) between the section 9 and the cover 10 remains unchanged in response to a rise or in response to a drop of temperature of the insert, e.g., in response to changes of temperature of a fluid which is compressed on its way through successive stages of the pump. It is often preferred to solder or weld the cover 10 to the section 9 of the insert 5.

Figure 2:
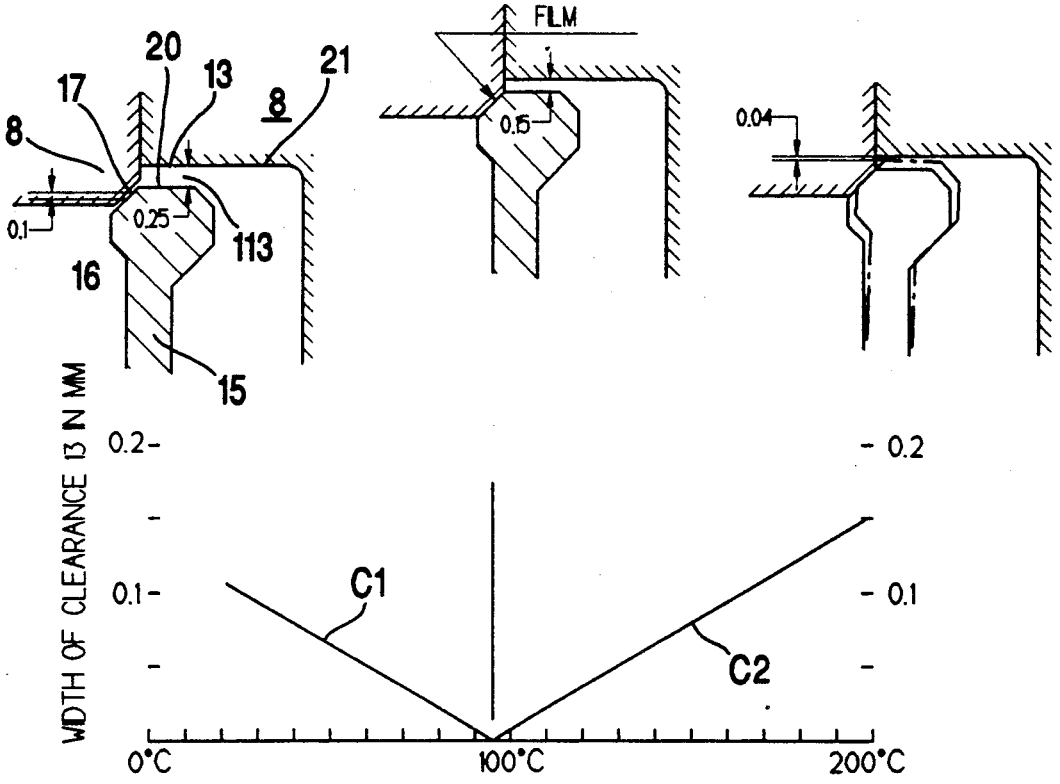
FIG. 2 is an enlarged view of a detail within the phantom-line circle Y in FIG. 1, showing a portion of an insert and a portion of the casing in three different positions relative to each other, namely when the surfaces at the second clearance are maintained at three different temperatures, the diagram in the lower part of FIG. 2 showing changes of the width of the second clearance and different stages of deformation of the insert at the three different temperatures.
Figure 3:
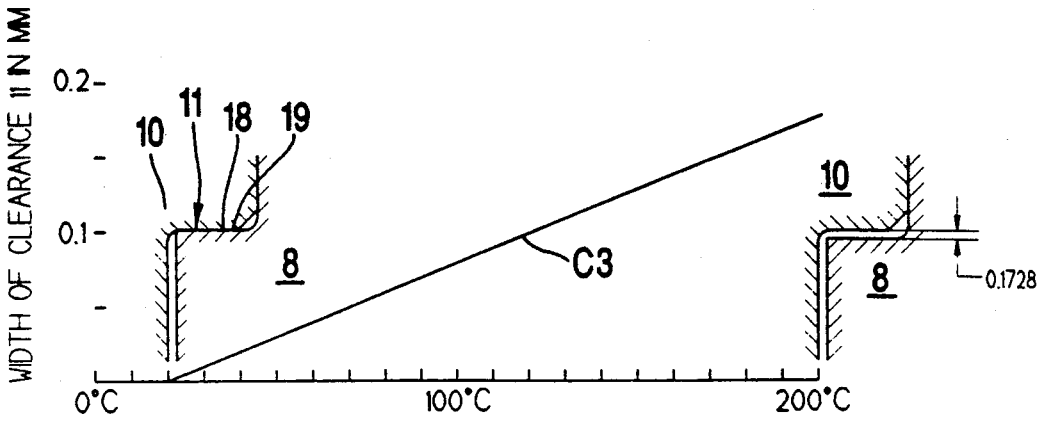
FIG. 3 is an enlarged view of a detail (shown twice) within the phantom-line circle X in FIG. 1, the diagram of FIG. 3 showing changes of the width of the first clearance in response to a temperature rise at the respective surfaces of the casing and an insert in the casing.

The cover 10 and the adjacent portion of the casing 8 have cylindrical or substantially cylindrical first surfaces 18 and 19, respectively, which define a first annular clearance 11 (see particularly FIG. 3). In addition, the cover 10 and the casing 8 have complementary frustoconical second surfaces 16, 17, respectively (see particularly FIG. 2), which define a second annular clearance 13. The clearance 11 can be replaced with an annular clearance 12 between the channeled and chambered section 9 of the insert 5 and the adjacent portion of the casing 8. The clearance 12 is indicated in FIG. 1 within the phantom-line circle Z. The surfaces 18, 19 can be used to center the insert 5 in the casing 9, the same as the surfaces bounding the clearance 12 if the clearance 12 is provided in lieu of the clearance 11. The frustoconical surfaces 16, 17 can also serve to center the insert 5 in the casing 8 when the width of the clearance 13 is at least close to zero.

FIG. 1 further shows axially parallel studs or pins 14 which extend into registering recesses (e.g., blind bores or holes) of the covers 10 and the adjacent portions of the casing 8 to ensure that the inserts are held against rotation with the impellers.

FIG. 2 shows the clearance 13 between the frustoconical surfaces 16, 17 of the cover 10 and casing 8 during three different stages of heating or cooling of the parts 8 and 10. Each of the three identical structures which are shown in FIG. 2 is an enlarged part of the machine within the phantom-line circle Y in FIG. 1. FIG. 2 further shows the abscissa and the ordinate of a coordinate system or diagram wherein the left-hand curve C1 denotes the reduction of width of the clearance 13 in response to a rise of temperature at the frustoconical surfaces 16, 17 and the right-hand curve C2 denotes the progressing elastic deformation of the radially outermost portion 15 of the cover 10 in response to a further rise of temperature at the surfaces 16 and 17. The system temperature is measured (in °C.) along the abscissa, and the width of the clearance 13 as well as the extent of deformation of portion 15 of the cover 10 are measured along the ordinate. The width of the clearance 13 and the extent of deformation of the portion 15 are measured in fractions of one millimeter.

At least the radially outermost portion 15 of the cover 10 is deformable and is preferably made of a slightly resilient material which can yield in response to further radial expansion of the cover 10 after the width of the clearance 13 has been reduced to zero. This ensures that the frustoconical surface 16 can slide radially outwardly along the complementary frustoconical surface 17. When the machine is cold, e.g., when the casing 8 and the portion 15 of the cover 10 are maintained at room temperature (which is assumed to be approximately 20° C.), the width of the clearance 13 is or approximates 0.1 mm. At the same time, the width of the cylindrical gap 113 between the cylindrical or nearly cylindrical peripheral surface 20 of the portion 15 and the adjacent cylindrical or nearly cylindrical internal surface 21 of the casing is or approximates 0.25 mm. It is to be noted that the widths of the clearance 13 and gap 113 are given only by way of example because such values depend on a number of variables.

If the temperature at the surfaces 16, 17 rises (e.g., to a temperature close to 100° C.), normally as a result of a rise of temperature of the fluid which is conveyed by the insert 5 from the impeller 3 to the impeller 4 of FIG. 1, the width of the clearance 13 decreases from 0.15 mm to zero or close to zero, and the width of the gap 113 is reduced from 0.25 mm to 0.15 mm. This is due to the fact that the extent of radially outward expansion of the radially outermost portion 15 of the cover 10 is more pronounced than the extent of radially inward expansion of the casing 8 at the frustoconical internal surface 17, namely at that surface which surrounds the surface 16. As the radially outward expansion of the portion 15 progresses simultaneously with the radially inward expansion of the casing portion at the surface 17, the width of the clearance 13 decreases jointly with that of the gap 113 so that the clearance 13 actually disappears and the conveyed fluid cannot leak from the gap 113 between the surfaces 20, 21 or in the opposite direction. The casing 8 is assumed to be made of a material (such as a ferritic material) having a first thermal expansion coefficient, and the insert 5 (or at least the cover 10 of the insert) is assumed to be made of a material (such as an austenitic material) having a greater or higher second thermal expansion coefficient.

If the temperature at the surfaces 16, 17 and 20, 21 continues to rise (e.g., to approximately 200° C.), the resilient portion 15 yields in response to further radially outward expansion of the cover 10 and in response to simultaneous radially inward expansion of the casing 8 at the surfaces 17 and 21 so that the width of the gap 113 decreases to approximately 0.04 mm while the width of the clearance 13 continues to remain to zero. This is possible because the resilient portion 15 of the cover 10 yields and slides substantially radially outwardly along the frustoconical surface 17 of the casing 8 to thus enable the surfaces 20, 21 to reduce the width of the gap 113.

It is often desirable and advantageous to coat the frustoconical surface 16 and/or 17 with a layer, e.g., a thin film, of suitable friction reducing material such as TEFLON (trademark). The film or layer is indicated in FIG. 2 by a legend and its purpose is to reduce the likelihood of adherence of the surface 16 to the surface 17 when the temperature at these surfaces rises to or exceeds 100° C. as well as to reduce wear upon the cover portion 15 and the casing 8 in the regions of their frustoconical surfaces.

The extent of deformation of portion 15 of the cover 10 in response to a rise of temperature from 100° to approximately 200° C. is indicated in the upper right-hand portion of FIG. 2 by phantom lines. The difference between the solid-line and phantom-line positions of the portion 15 in FIG. 2 is that which is necessary (as a result of heating of the parts 10, 8 at the surfaces 16, 17 and the ensuing resilient deformation of the portion 15) in order to maintain the width of the clearance 13 at zero while reducing the width of the gap 113 from 0.15 mm to 0.04 mm.

It will be appreciated that the temperature at the surfaces 16, 17 and 20, 21 can rise well above 200° C. or that the upper limit of the temperature at the clearance 13 and gap 113 can be less than 200° C. The dimensions of the casing 8 at the surfaces 17, 21 and the dimensions of the cover 10 at the surfaces 16, 20 will be selected with a view to ensure that the width of the clearance 13 will be reduced to zero within a certain temperature range (from approximately 100° C. to approximately 200° C. in FIG. 2), and that such width will or can exceed zero within another temperature range (0° C. to approximately 100° C. in FIG. 2), preferably at a time when the width of the clearance 11 or 12 is zero or close to zero. It will be noted that the surfaces bounding the clearances 11 and 12 are disposed radially inwardly of the surfaces 16, 17 at the clearance 13.

FIG. 3 shows that the surface 18 of the cover 10 at the clearance 11 is a substantially cylindrical internal surface and that the confronting surface 19 is a substantially cylindrical external surface of the corresponding portion of the casing 9. Thus, and since the thermal expansion coefficient of the material of the cover 10 is higher than that of the material of the casing 8, the surface 18 will migrate radially outwardly and away from the surface 19 when the temperature at these surfaces increases. The curve C3 in the diagram of FIG. 3 indicates the increase in the width of the clearance 11 as the temperature at the surfaces 18, 19 rises from zero to 200° C. The temperature (in °C.) is measured along the abscissa and the width of the clearance 11 is measured along the ordinate of the coordinate system in the lower part of FIG. 3. It will be seen that the width of the clearance 11 increases continuously as the temperature at the surfaces 18, 19 rises. On the other hand, and as can be seen by the curve C1 of FIG. 2, the width of the clearance 13 at first decreases to zero and thereupon remains zero as the temperature at the surfaces 16, 17 continues to rise from 0° C. to approximately 200° C. Since the temperature at the surfaces 16, 17 can be assumed to rise simultaneously with and to the same extent as the temperature at the surfaces 18, 19, a reduction of the width of the clearance 13 takes place simultaneously with an increase of the width of the clearance 11.

The width of the clearance 11 is zero or close to zero at room temperature (e.g., at 20° C.), i.e., at a time when the width of the clearance 13 reaches the maximum value (0.1 mm in the upper left-hand portion of FIG. 2). This is achieved by appropriate machining of the surfaces which define the clearance 11, namely in such a way that the fit of surfaces 18, 19 at the clearance 11 can be a so-called press fit at room temperature and thereupon changes to a so-called intermediate fit (between a tight fit and a loose fit) to thereupon change to a loose fit, e.g., at a temperature of approximately 100° C. or higher. FIG. 3 shows, by way of example, that the width of the clearance 11 can reach 0.1728 mm when the temperature at the surfaces 18, 19 rises to approximately 200° C.

As already explained with reference to FIG. 2, the temperature at the surfaces 18, 19 can rise well above 200° C. or such temperature can remain below or even well below 200° C., depending upon the temperature of the fluid which is being conveyed in the centrifugal pump embodying the structure of FIG. 3.

An important advantage of the feature that the width of the clearance 11 is zero or close to zero when the width of the clearance 13 exceeds zero and the other way around is that the casing 8 and/or the cover 10 of the insert 5 cannot undergo excessive deformation within either of the two temperature ranges.

The manner in which the surfaces of the casing 8 and section 9 of the insert 5 cooperate to define the clearance 12 within the phantom-line circle Z of FIG. 1 is or can be the same as described with reference to the surfaces 18, 19 of FIG. 2. The clearance 12 can be established in lieu of the clearance 11. It is presently preferred to provide a single first clearance (11 or 12) at a first radial distance from the common axis A of the impellers 3, 4 and to provide a single second clearance (13) at a greater radial distance from the axis A. Thus, and referring to FIG. 1, the casing 8 and the numbered or referenced insert 5 can define a first clearance 11 or 12 and a second clearance 13.

At first, the utilization of materials having different thermal expansion coefficients would appear to be at odds with the requirement to reduce the rate of leakage of conveyed fluid to a minimum because the width of a single clearance between two parts having different thermal expansion coefficients will continuously increase or continuously decrease in response to any consistent temperature change in a direction toward a maximum value or in a direction toward a minimum value. However, the improved fluid flow machine is designed in such a way that the parts which should limit the flow of leak fluid between them define two clearances at different radial distances from the axis of rotation of the rotary component or components of the machine. In addition, the surface 17 of the casing 8 surrounds the surface 16 of the cover 10 (insert 5) in the region where the width of the clearance (13) should decrease in response to heating of the materials at such surfaces, whereas the surface 18 of the cover 10 (insert 5) surrounds the surface 19 of the casing 8 in the region where the width of the clearance (11) can or should increase in response to heating. Such design of the fluid flow machine renders it possible to regulate the combined clearance between the casing 8 and the insert 5 with a high degree of precision and predictability. Moreover, such design ensures that the casing 8 and/or the insert 5 is not unduly stressed when the temperature at the surfaces 16, 17 and 18, 19 rises, e.g., in response to a rise of temperature of the conveyed fluid.

The utilization of an austenitic material for the insert 5 exhibits the additional advantage that such highly wear-resistant and tough material prolongs the useful life of the insert 5.

The feature that the clearance 11 is zero or close to zero and the width of the clearance 13 is at a maximum value when the machine is cold (i.e., before the machine is started) exhibits several important advantages. Thus, the pump shaft 1 is unlikely to exert undue pressure against the bearing or bearings and/or against the seal or seals during the starting stage, i.e., when the temperature of the fluid and of the materials at the surfaces 16, 17 and 18, 19 is on the increase. The same holds true when the temperature of the parts bounding the surfaces 16, 17 and 18, 19 begins to drop, e.g., down to room temperature in the range of 20° C. In the absence of the just discussed feature, the casing 8 would be likely to urge the shaft 1 into excessive deforming engagement with the bearing or bearings and/or with the seal or seals.

A further advantage of the improved machine is that the insert 5 is always properly centered by the housing 8, namely at the surfaces 18, 19 when the temperature of the adjacent portions of the casing 8 and cover 10 is relatively low, and by the surfaces 16, 17 when the temperature in the region of these surfaces rises so that the width of the clearance 13 is reduced to zero or close to zero. In other words, the surfaces 16, 17 or 18, 19 ensure desirable and accurate centering of the insert 5 during each and every stage of operation of the fluid flow machine; this is desirable and advantageous because the insert is not subjected to the action of excessive hydraulic radial forces.

The feature that the clearance 13 is defined by frustoconical surfaces 16 and 17 exhibits the advantage that the forces acting between such surfaces when the width of the clearance 13 is reduced to zero as a result of heating beyond a given temperature range will act in the radial and axial directions of the pump shaft 1. This is desirable and advantageous if the portion 15 of the cover 10 is at least slightly resilient so that it can undergo temporary deformation in response to heating of the portion 15 and of the adjacent portion of the casing 8. The aforementioned thin film of friction reducing material is preferably provided on the surface 16, i.e., on the insert 5. The ability of the portion 15 to slide along the surface 17 in response to heating of the materials at the surfaces 16 and 17 can be enhanced by appropriate selection of conicity of the surfaces 16 and 17.

A combination of features including the provision of frustoconical surfaces 16, 17 and the utilization of a resiliently deformable cover 10 ensures that the cover can slide along the surface 17 during that intermediate stage of operation of the machine when the temperature of the fluid is on the rise toward the operating temperature (e.g., from room temperature at 20° C. to an operating temperature of close to or above 200° C.). Therefore, the casing 8 is highly unlikely to be subjected to excessive deforming stresses, and the same applies for the insert 5.

As a rule, the surfaces 16, 17 and 18, 19 are true frustoconical and true cylindrical surfaces with centers on the axis A of the pump shaft 1. The insert 5 is centered only by the surfaces 18, 19 when the fluid flow machine is cold and while the casing 8 is acted upon by pressure.

The fit of the surfaces 18, 19 at room temperature can be an intermediate fit (between a tight fit and a loose fit), i.e., one can assume that the width of the clearance 11 is zero or close to zero during assembly of the machine and when the machine is cold (e.g., at room temperature). On the other hand, the fit at the surfaces 16, 17 can be termed a loose fit, i.e., there is a path for the flow of fluid between such surfaces when the machine is cold.

When the temperature of the casing 8 and of the insert 5 increases, primarily as a result of heating by the properly tempered fluid which directly contacts the insert 5 practically all the way between the impellers 3, 4 and which directly contacts the casing 8 in the chamber 7, the width of the clearance 13 decreases while the width of the clearance 11 is on the increase. The rate of thermally induced expansion of the austenitic insert 5 is greater than the rate of thermally induced expansion of the ferritic housing 8. Since the thermal expansion coefficients of the materials of the casing 8 and insert 5 are known, the designer can readily dimension and configurate the surfaces 16, 17 and 18, 19 in such a way that the width of the clearance 13 is reduced to zero at a particular temperature of the adjacent portions of the casing 8 and cover 10 as well as that the portion 15 of the cover 10 undergoes deformation and slides along the surface 17 while the temperature of the conveyed fluid is within a selected range.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A fluid flow machine comprising a casing consisting of a first material having a first thermal expansion coefficient; at least one impeller rotatable in said casing about a predetermined axis; and at least one fluid guiding insert disposed in said casing adjacent said at least one impeller and consisting of a second material having a second thermal expansion coefficient higher than said first coefficient, said casing and said at least one insert having first surfaces disposed at a first radial distance from said axis and defining a first annular clearance, and second surfaces disposed at a greater second radial distance from said axis and defining a second annular clearance, one of said clearances having a width which is zero or slightly above zero when the temperature at the respective surfaces is within a first range and the other of said clearances having a width which is zero or slightly above zero when the temperature at the respective surfaces is within a higher second range.

2. The fluid flow machine of claim 1, wherein said first material is a ferritic material and said second material is an austenitic material.

3. The fluid flow machine of claim 1, wherein said one clearance is defined by said first surface and the width of said second clearance is greater than zero when the temperature at said second surfaces is within said first range.

4. The fluid flow machine of claim 1, wherein the width of said first clearance increases in response to a rise of temperature at said first surfaces.

5. The fluid flow machine of claim 4, wherein the first surface of said at least one insert at least partially surrounds the first surface of said casing.

6. The fluid flow machine of claim 1, wherein the width of said second clearance decreases in response to a rise of temperature at said second surfaces.

7. The fluid flow machine of claim 6, wherein the second surface of said casing at least partially surrounds the second surface of said at least one insert.

8. The fluid flow machine of claim 1, wherein the second surface of said casing is engaged by the second surface of said at least one insert and centers said at least one insert when the temperature at said second surfaces is within said second range.

9. The fluid flow machine of claim 1, wherein said casing and said at least one insert are interfitted at said second surfaces and said second surfaces are at least substantially complementary conical surfaces.

10. The fluid flow machine of claim 1, wherein the second surface of said at least one insert is provided on a deformable portion of said at least one insert.

11. The fluid flow machine of claim 10, wherein said deformable portion of said at least one insert is resilient.

12. The fluid flow machine of claim 1, wherein said at least one insert is of one piece.

13. The fluid flow machine of claim 1, wherein said at least one insert consists of at least two separately produced interconnected sections.

14. The fluid flow machine of claim 1, wherein said at least one insert comprises a channeled section and a cover for said channeled section, at least one of the first and second surfaces of said at least one insert being provided on said cover.

15. The fluid flow machine of claim 14, wherein said cover is adjacent said channeled section as seen in the direction of said axis.

16. The fluid flow machine of claim 1, further comprising a layer of friction reducing material overlying at least one of said second surfaces.

17. The fluid flow machine of claim 16, wherein said second surfaces are conical surfaces.

* * * * *